US008721802B2

(12) United States Patent
Cantrell et al.

(10) Patent No.: US 8,721,802 B2
(45) Date of Patent: May 13, 2014

(54) CONDITION WARNING SYSTEM, CONTROL SYSTEM AND METHOD FOR POT AND PAN WASHING MACHINE

(75) Inventors: John W. Cantrell, Leawood, KS (US); Mark Churchill, Grain Valley, MO (US)

(73) Assignee: Unified Brands, Inc., Jackson, MS (US)

( * ) Notice: Subject to any disclaimer, the term of this patent is extended or adjusted under 35 U.S.C. 154(b) by 148 days.

(21) Appl. No.: 13/080,453

(22) Filed: Apr. 5, 2011

(65) Prior Publication Data

US 2011/0240062 A1 Oct. 6, 2011

Related U.S. Application Data

(63) Continuation-in-part of application No. PCT/US2009/059600, filed on Oct. 5, 2009.

(60) Provisional application No. 61/394,763, filed on Oct. 19, 2010, provisional application No. 61/102,866, filed on Oct. 5, 2008, provisional application No. 61/149,909, filed on Feb. 4, 2009.

(51) Int. Cl.
*B08B 3/00* (2006.01)

(52) U.S. Cl.
USPC ..... 134/25.2; 134/34

(58) Field of Classification Search
None
See application file for complete search history.

(56) References Cited

U.S. PATENT DOCUMENTS

| | | | | |
|---|---|---|---|---|
| 2,781,765 | A | 2/1957 | Steidley | |
| 3,918,479 | A | 11/1975 | Perl | |
| 4,509,543 | A * | 4/1985 | Livingston et al. | 134/57 D |
| 4,773,436 | A * | 9/1988 | Cantrell et al. | 134/108 |
| 4,805,649 | A * | 2/1989 | Nezworski | 134/57 R |
| 5,775,347 | A | 7/1998 | Hoover et al. | |
| 7,475,698 | B2 | 1/2009 | Bigott | |
| 7,527,062 | B2 | 5/2009 | Bigott | |
| 7,578,305 | B2 | 8/2009 | Bigott | |
| 7,763,119 | B2 | 7/2010 | Bigott | |
| 2004/0244822 | A1 | 12/2004 | Cantrell | |
| 2006/0174915 | A1 | 8/2006 | Hedstrom et al. | |
| 2010/0282281 | A1 | 11/2010 | Bigott | |
| 2012/0211028 | A1 | 8/2012 | Bigott | |

FOREIGN PATENT DOCUMENTS

| | | | |
|---|---|---|---|
| CN | 1211941 | A | 3/1999 |
| CN | 2423856 | Y | 3/2001 |
| CN | 2785728 | Y | 6/2006 |
| CN | 101272724 | A | 9/2008 |

OTHER PUBLICATIONS

Written Opinion of the International Search Authority for PCT/2009/059600, mailed Feb. 22, 2010.

* cited by examiner

*Primary Examiner* — Nicole Blan
(74) *Attorney, Agent, or Firm* — Kutak Rock LLP; Bryan P. Stanley

(57) ABSTRACT

A condition warning system for an apparatus such as a pot and pan washing machine, a control system and control methods for a pot and pan washing machine are provided. The condition warning system includes a control system that monitors operational, safety or compliance parameters of an apparatus, and a light that illuminates a location below (or above) an operator's direct line of sight, and which is outside of the operator's direct line of sight. The control system and control methods include a punitive wash action lockout, an extended wash cycle time, and a deep clean wash cycle.

18 Claims, 10 Drawing Sheets

CONDITION WARNING SYSTEM, CONTROL SYSTEM AND METHOD FOR POT AND PAN WASHING MACHINE

CROSS-REFERENCE TO RELATED APPLICATIONS

This application claims priority pursuant to 35 U.S.C. 119 (e) to U.S. Provisional Patent Application Ser. No. 61/394,763 filed Oct. 19, 2010, and is a continuation-in-part of International Application No. PCT/US2009/059600, which claims priority to U.S. Provisional Patent Application Ser. No. 61/102,866, filed Oct. 5, 2008, and to U.S. Provisional Patent Application Ser. No. 61/149,909, filed Feb. 4, 2009, the entire disclosures of which are incorporated herein by reference.

FIELD OF THE INVENTION

The present invention relates to a condition warning system, control system and control methods for a pot and pan washing machine.

BACKGROUND OF THE INVENTION

Pot and pan washing machines, of the type used in restaurants, institutions and other eating facilities often involve a large wash tank or basin in which water is circulated to provide a continuous motion rolling wash action for the pots and pans and other "wares" (i.e. pots, pans, utensils, flatware/silverware, etc.). One such continuous motion style pot and pan washing machine is described in U.S. Pat. No. 4,773,436 issued to Cantrell et al., the entire disclosure of which is incorporated herein by reference. The machine of Cantrell includes a wash tank with multiple jets evenly spaced apart at an elevated position along the rear wall of the wash tank. The tank is filled with water to a level above the position of the jets. Pots and pans are placed in the wash tank, and a wash pump is activated to draw water from within the wash tank and direct it through the jets to create a jet stream. Each jet directs its jet stream toward the bottom wall of the wash tank, the bottom wall then deflects the jet stream upward and towards the front wall of the tank. The front wall then deflects the upward moving jet stream towards the rear wall of the tank, and the rear wall deflects the jet stream downward and back towards the front wall along the bottom wall. The combination of deflections of the jet stream from the bottom, front and rear walls provides a rolling washing action within the wash tank. Typically, the rolling wash action is continuous through the washing cycle of the machine, and wares are loaded and unloaded during the washing cycle as they are deemed clean by an operator of the machine. In this manner, multiple loads of wares are cleaned during a single washing cycle.

Although the prior art pot and pan washing machine disclosed in U.S. Pat. No. 4,773,436 provides an exceptional wash action, many of the components discussed above hinder the overall efficiency and performance of the machine. The inventions disclosed in U.S. application Ser. Nos. 09/947,484; 09/947,485; and 10/744,666, the entire disclosures of which are incorporated herein by reference, provide components that greatly increase the overall efficiency and performance of the machine, including improvements to the intake and discharge manifolds, jets, pump and system assembly methods. Nevertheless, none of these improvements, nor the machine of U.S. Pat. No. 4,773,436 address a number of disadvantages in typical condition warning systems, control systems and control methods for such machines.

Conventional control systems and control methods for continuous motion style pot and pan washing machines typically include control logic that limits a washing cycle to a predetermined run-time. Once the predetermined run-time has elapsed, operation of the wash pump is disabled and the wash tank of the machine must be drained and refilled before another wash cycle can begin. This ensures that the cleansing fluid solution in the wash tank is usually drained and refilled before the soil level in the fluid significantly and detrimentally impacts the cleaning efficiency of the fluid within the washing machine. In many applications, a run-time of four (4) hours has been found to be an adequate cycle run-time before refilling of a wash tank is desired. Nevertheless, it will be appreciated that a number of different factors impact the desired predetermined run-time for a particular application. Also, in certain situations, a wash cycle will be prematurely terminated before the predetermined runtime has elapsed. For example, in some machines a safety kill switch is included in the control system to shut down the entire system when the fluid temperature in the wash tank exceeds a predetermined safe operating temperature. In such case, regardless of the elapsed run time, the wash tank must be drained and refilled, and a new wash cycle must be initiated before the washing machine will operate again.

Although conventional control systems and methods discussed above do provide benefits in ensuring safe and/or efficient conditions for the cleansing fluid solution in the wash tank, the requirement that a new wash cycle be initiated limits the ability to utilize the same or similar control systems or methods for enforcing compliance with many desired machine operational conditions, that are less critical than safe operating temperature and/or cleansing fluid soil level (such as: preferred wash, rinse or sanitizer fluid operating temperatures; preferred wash, rinse or sanitizer tank/supply operating fluid levels; preferred wash, rinse or sanitizer fluid operating chemical concentration levels; chemical supply levels, pressures or concentrations; etc.). Therefore, it would be beneficial to provide control systems and methods that help to ensure or enforce compliance with such operational conditions, and which do not require resetting of the washing cycle and/or draining and refilling of the wash tank.

Furthermore, the predetermined run-time often causes difficulties toward the end of a wash cycle. Because wares are loaded and unloaded throughout the wash cycle, wares loaded towards the end of the wash cycle may not become adequately cleaned before the wash cycle is completed. Thus, the wash tank must be drained and refilled and a new wash cycle initiated to finishing cleaning those wares. If a facility is close to shutting down for the day, refilling the wash tank ends up being extremely time consuming as well as a waste of resources. This problem is further augmented by the fact that conventional washing machines do not provide operator's any indication of elapsed run-time or any notice in advance of completion of a wash cycle. Thus, unless an operator makes note of when a wash cycle is initiated, it is impossible for the operator to determine when a wash cycle will be completed. Therefore, it would be beneficial to provide control systems and methods that allow an operator to adequately wash wares at or toward the end of a wash cycle without requiring initiation of a new wash cycle.

Conventional control systems and control methods for continuous motion style pot and pan washing machines typically include a single standard/normal washing cycle, which limits a wash cycle to a predetermined run-time in the manner discussed above. In some machines, the control systems maintain a minimum or predetermined fluid temperature within the wash tank after a washing cycle is completed to improve soaking effectiveness. This enables an overnight washing mode in which heavily soiled wares can be placed in the wash tank and cleaned during the entire washing cycle and additionally soaked for the remainder of the night after the washing cycle is completed and before the items are removed in the morning. While this does improve the ability to clean heavily soiled items, the fluid is often no longer emulsified by the time items are removed, soil coagulates on the surface the fluid and even reattaches to the wares. Thus, additional or redundant cleaning is often necessary. Thus, it would be beneficial to provide control system and methods that improve a washing machine's cleaning of heavily soiled items.

Conventional control systems and control methods for continuous motion style pot and pan washing machines, as well as those for other apparatuses (including, but not limited to kitchen appliances, automated manufacturing machinery, milling machines, conveyor systems, condition monitoring equipment, and the like) in which operational, safety or compliance parameters are monitored, typically utilize condition warning systems that either require an operator (defined broadly herein as any person that controls or monitors an apparatus) to closely monitor a display or control panel directly in front of the operator, or otherwise provide loud audible alarms or visual warnings that are directly in the line of sight of the operator. In addition to alerting the operator of an apparatus, audible alarms and line of sight visual warning signals also tend to alert other persons in the general vicinity to whom such alarms or signals are not intended and often undesirable to be communicated. In particular, in restaurants, loud audible buzzers and/or line of sign visual signals tend to detract from a customer's dining experience, and also can cause confusion and/or frustration among employees that are delegated to various different tasks that each utilize similar alert methods. Therefore, it would be beneficial to provide a condition warning system that does not require an operator to closely monitor a display or control panel and which at the same time minimizes the communication of alert signals to undesired and/or inappropriate recipients.

SUMMARY OF THE INVENTION

The instant inventions provide improvements to condition warning systems for apparatuses such as continuous motion style pot and pan washing machines (and also including, but not limited to apparatuses such as kitchen appliances, automated manufacturing machinery, milling machines, conveyor systems, condition monitoring equipment, and the like), and control systems and control methods for continuous motion style pot and pan washing machines, such as those described in any of U.S. Pat. No. 4,773,436, or U.S. application Ser. Nos. 09/947,984, 09/947,484 and 10/744,666. It will be appreciated that other apparatuses, washing machines, or various combinations of washing machine or other components may be utilized without departing from the spirit and scope of the instant invention.

An embodiment of the instant invention includes a control system incorporated into a continuous motion style pot and pan washing machine. In a preferred embodiment, the control system includes a microprocessor, or other suitable computer processor, for performing various operations as defined in the firmware/software programming of the logic of the control system. The microprocessor includes, or is otherwise connected to one or more storage media, including but not limited to ROM, RAM, magnetic disk drives, etc., in which firmware for, software for and/or data collected or generated by the control system is utilized, accessed and/or stored. The microprocessor is connected to and/or controls all operational functions/components of the machine, including but not limited to: a wash pump, heater, chemical supply system pumps, valves (drain or fill), timers, temperature sensors, fluid level sensors, chemical/fluid supply level sensors, pressure sensors, chemical concentration sensors, etc.

In one embodiment of the instant invention, the control system includes a punitive wash action lockout in which operation of the wash pump (and thus circulation within the wash tank) of a continuous motion pot and pan washing machine is punitively and temporarily locked out by the control system to help ensure or enforce compliance with certain operational conditions, without requiring resetting of the washing cycle and/or draining and refilling of the wash tank to restore operation of the wash pump. In one embodiment, the operational conditions are independent of conditions of the wash tank (e.g. within a sanitizer tank, or rinse tank/system); but the punitive lockout locks out operation of the wash pump of the wash tank. This encourages an operator to correct the compliance issue so that washing may continue. In one embodiment, the punitive wash action lockout comprises a method of washing wares in a continuous motion style pot and pan washing machine, said method comprising the steps of:

monitoring by a control system one or more compliance parameters relating to operation of the pot and pan washing machine during normal operation;

locking out punitively and temporarily by said control system operation of a wash pump based upon said one or more compliance parameters meeting one or more specified punitive lockout conditions, wherein said locking out step includes the step of locking out the operation of the wash pump during a washing cycle when said one or more compliance parameters meet said one or more punitive lockout conditions;

restoring operation of the wash pump when said one or more compliance parameters no longer meet said one or more punitive lockout conditions.

In a preferred embodiment of the punitive wash action lockout said restoring step is performed without requiring the complete draining or refilling of one or more tanks of the pot and pan washing machine. In one such embodiment, said restoring step is performed without requiring the complete draining or refilling of the wash tank of the pot and pan washing machine.

In another preferred embodiment of the punitive wash action lockout said restoring step requires substantially completely draining and refilling of one or more tanks of the pot and pan washing machine without resetting said washing cycle. In one such embodiment, said restoring step requires substantially completely draining and refilling of one or more tanks of the pot and pan washing machine other than the wash tank.

In another preferred embodiment of the punitive wash action lockout said step of locking out the operation of the wash pump interrupts a timed length of said washing cycle. In such embodiment, the total elapsed time from when the washing cycle is initiated to when the washing cycle is completed will include the predetermined timed length (run-time) of the wash cycle plus whatever length of time the wash pump is locked out.

In another preferred embodiment of the punitive wash action lockout said step of locking out the operation of the wash pump does not interrupt a timed length of said washing cycle. In such embodiment, the total elapsed time from when the washing cycle is initiated to when the washing cycle is completed will equal the predetermined timed length (run-time) of the washing cycle.

In another preferred embodiment of the punitive wash action lockout said continuous style pot and pan washing machine includes more than one wash pump.

In another preferred embodiment of the punitive wash action lockout said one or more compliance parameters includes one or more of fluid temperature, fluid level, or fluid chemical concentration level within a wash tank of the pot and pan washing machine, and said one or more punitive lockout conditions includes one or more of a fluid temperature above a predetermined high limit or below a predetermined low limit, a fluid level above a predetermined limit or below a predetermined limit, or a fluid chemical level above a predetermined limit or below a predetermined limit. In one such embodiment said one or more compliance parameters includes fluid temperature and said one or more punitive lockout conditions includes a fluid temperature above a predetermined high limit, said method further comprising the step of requiring substantially completely draining and refilling the wash tank to resume normal operation if said fluid temperature exceeds a second predetermined safety limit that is in excess of said high limit.

In another preferred embodiment of the punitive wash action lockout said one or more compliance parameters includes one or more of fluid temperature, fluid level or fluid chemical concentration level within a sanitizer tank of the pot and pan washing machine, and said one or more punitive lockout conditions includes one or more of a fluid temperature above a predetermined limit or below a predetermined limit, a fluid level above a predetermined limit or below a predetermined limit, or a fluid chemical concentration level above a predetermined limit or below a predetermined limit. In one such embodiment the pot and pan washing machine includes a wash tank in addition to the sanitizer tank and said locking out step includes the step of locking out punitively temporarily the operation of a wash pump for the wash tank. It will further be appreciated that in some embodiments of the instant invention, non-chemical sanitizers, such as UV light, or other sanitizers now known or hereafter developed, may be utilized instead of a chemical sanitizer without departing from the spirit and scope of the instant invention. In such embodiments, specific compliance parameters will be apparent to those of ordinary skill in the art.

In another preferred embodiment of the punitive wash action lockout said one or more compliance parameters includes one or more of fluid temperature, fluid level or fluid chemical concentration level within a rinsing tank of the pot and pan washing machine, and wherein said one or more punitive lockout conditions includes one or more of a fluid temperature above a predetermined limit or below a predetermined limit, a fluid level above a predetermined limit or below a predetermined limit, or a fluid chemical concentration level above a predetermined limit or below a predetermined limit. In one such embodiment of the punitive wash action lockout the pot and pan washing machine includes a wash tank in addition to the rinsing tank and said locking out step includes the step of punitively temporarily locking out the operation of a wash pump for the wash tank.

In another preferred embodiment of the punitive wash action lockout said one or more compliance parameters includes one or more of fluid temperature, fluid level or fluid chemical concentration level within a spray rinsing system of the pot and pan washing machine, and said one or more punitive lockout conditions includes one or more of a fluid temperature above a predetermined limit or below a predetermined limit, a fluid level above a predetermined limit or below a predetermined limit, a fluid chemical concentration level above a predetermined limit or below a predetermined limit, or a fluid pressure above a predetermined limit or below a predetermined limit. In one such embodiment the pot and pan washing machine includes a wash tank in addition to the spray rinsing system and wherein said locking out step includes the step of punitively temporarily locking out the operation of a wash pump for the wash tank. An exemplary embodiment of a spray rinsing system suitable for use in connection with this particular embodiment of the instant invention is described in U.S. Application Ser. No. 61/178,617, the entire disclosure of which is incorporated herein by reference. Nevertheless, it will be appreciated that alternative spray rinsing systems, including but not limited to a traditional spray rinsing hose and rinse sink assembly, may be utilized without departing from the spirit and scope of the instant invention.

In another preferred embodiment of the punitive wash action lockout said one or more compliance parameters includes one or more chemical supply levels, pressures or concentrations within a chemical supply system that supplies chemical to one or more tanks or spray rinsing systems of the pot and pan washing machine, and said one or more punitive lockout conditions includes at least one chemical supply level below a predetermined level, pressure or concentration.

In another preferred embodiment of the punitive wash action lockout the method further comprises the step of activating a condition warning system during said locking out step. In one such embodiment said condition warning system includes a light that is focused to illuminate a location that is below (or alternatively, above) an operator's direct line of sight and wherein a source of illumination is outside of the operator's direct line of sight. In another such embodiment said condition warning system includes an audible alarm.

In another embodiment of the instant invention, the control system includes a extended wash cycle, that allows an operator to adequately wash wares at or toward the end of a wash cycle without requiring initiation of a new wash cycle. The extended wash cycle allows the operator to run the pump(s) of the wash tank for an additional finite period of time, after the predetermined run-time of the wash cycle has elapsed. In one such embodiment the extended wash cycle includes a method of washing wares in a continuous motion style pot and pan washing machine, said method comprising the steps of:

monitoring by a control system one or more parameters of fluid within a wash tank of the washing machine, wherein said one or more parameters includes a wash cycle run-time parameter (e.g. the length of time in which a fluid has been circulating in or present in the wash tank);

locking out by said control system operation of the washing machine based upon said one or more parameters meeting one or more specified conditions, wherein said locking out step includes the step of locking out the operation of a wash pump when said wash cycle run-time parameter reaches a wash cycle run-time condition (e.g. predetermined washing cycle run-time);

activating the wash pump by said control system to circulate a fluid (such as water, water/soap mixture, or other cleansing solution) within said wash tank during a wash cycle; and providing by said control system an option to delay said step of locking out operation of said wash pump for at least one additional finite time period;

locking out operation of said wash pump by said control system after the at least one additional finite time period has concluded; and requiring substantially complete draining of said wash tank after the at least one additional finite time period has concluded and prior to initiation of a new wash cycle.

In a preferred embodiment of the extended wash cycle said one or more parameters includes one or more fluid level parameters, and said locking out step includes the step of locking out the operation of the wash pump when said fluid level parameter is below a fluid level condition; said method further comprising:

determining by said control system whether said fluid level parameter is below a low fluid level condition;

filling said wash tank with fluid upon determining said fluid level parameter is below said low fluid level condition;

providing by said control system selection options of at least a standard wash mode upon determining said fluid level parameter is above a high fluid level condition; and initiating a wash cycle upon selection of said standard wash mode. In one such embodiment, the method further comprises the step of:

adding a cleansing chemical to said fluid to result in a cleansing fluid solution in said wash tank.

In another embodiment of the extended wash cycle of the instant invention the method further comprises the step of:

alerting a machine operator as said wash cycle run-time parameter closely approaches said wash cycle run-time condition.

In another embodiment of the extended wash cycle of the instant invention said at least one additional finite time period is less than said wash cycle run-time condition. In one such embodiment said at least one additional finite time period is less than 25% of said wash cycle run-time condition.

In another embodiment of the extended wash cycle of the instant invention a combination of said at least one additional finite time period and said wash cycle run-time condition is no greater than a predetermined maximum safe cycle time for a wash cycle of said machine.

In another embodiment of the instant invention, the control system includes a deep clean cycle to improve a washing machine's cleaning of heavily soiled items. The deep cleaning cycle is a separate washing cycle or mode from the normal or standard washing cycle of a preferred embodiment. In one such embodiment the deep clean cycle includes a method of washing wares in a continuous motion style washing machine, said method comprising the steps of:

providing by a control system selection options of at least two different wash modes, said at least two different wash modes including at least a standard wash mode and a deep cleaning wash mode;

initiating a standard washing cycle upon selection of said standard wash mode, said first washing cycle including the steps of:

activating a wash pump by said control system to circulate a fluid within a wash tank;

maintaining a standard temperature range for said fluid during said standard washing cycle; and locking out said pumping system upon completion of said standard washing cycle;

initiating a deep cleaning washing cycle upon selection of said deep cleaning wash mode, said deep cleaning washing cycle including the steps of:

operating continuously a wash pump by said control system to circulate a fluid within said wash tank during a first segment of said deep cleaning washing cycle;

maintaining a deep cleaning temperature range for said fluid during said first segment of said deep cleaning washing cycle, said deep cleaning temperature range being generally higher than said standard temperature range;

deactivating and subsequently reactivating said wash pump for periodic intervals during an energy saving idle mode segment of said deep cleaning washing cycle after completion of said first segment;

maintaining a lower deep cleaning temperature range for said fluid during said energy saving idle mode segment of said deep cleaning washing cycle, said lower deep cleaning temperature range being generally lower than said deep cleaning temperature range.

In one embodiment of said deep clean wash cycle said deactivating and subsequently reactivating step of said deep cleaning washing cycle intervals of deactivation of said wash pump are generally longer than intervals of reactivation of said wash pump.

In another embodiment of said deep clean wash cycle said steps of maintaining temperatures include the step of energizing a heating element solely during operation of said wash pump. In such embodiment, the heating element may be located within a pumping system to heat the fluid as it is drawn through the pumping system.

In one embodiment of said deep clean wash cycle said steps of maintaining temperatures include the step of energizing a heating element both during operation and during deactivation of said wash pump. In such embodiment, the heating element is capable of heating fluid within the wash tank within requiring fluid to be drawn through the pumping system.

In one embodiment of said deep clean wash cycle said deactivating and subsequently reactivating step of said deep cleaning washing cycle includes first intervals of deactivation and reactivation of said wash pump while the temperature of said fluid is above said lower deep cleaning temperature range, and second intervals of deactivation and reactivation of said wash pump after the temperature of said fluid is lowered to a temperature within said lower deep cleaning temperature range.

Another embodiment of the instant invention includes a condition warning system connected to the control system. One embodiment of the condition warning system includes:

a control system that monitors operational, safety or compliance parameters of an apparatus; and a light operably connected to said control system, said light being mounted at a position and focused in a direction that illuminates a location below an apparatus operator's direct line of site and wherein a source of illumination is outside of the operator's direct line of sight.

In an alternative embodiment, the light is mounted at a position and focused in a direction that illuminates a location generally above an operator's direct line of site and wherein a source of illumination is outside of the operator's direct line of sight.

In one embodiment of the condition warning system said apparatus comprises a kitchen appliance. In one specific embodiment, said kitchen appliance comprises a continuous motion style pot and pan washing machine.

In another embodiment of the condition warning system said apparatus includes a work surface at a height that is generally convenient for access by the apparatus operator. In one such embodiment said light is mounted below the height of said work surface. In a more specific embodiment said light is mounted underneath said work surface. In another such embodiment of the condition warning system said light is focused in a direction that illuminates a location generally directly below said light. In a more specific embodiment said location generally directly below said light is a floor surface directly below said light. In another embodiment said location generally directly below said light is at least partially shaded from light sources within the area in which said light is located.

In another embodiment of the condition warning system said light is mounted at a height generally below 52 inches. In one such embodiment, said light is mounted at a height generally below 48 inches. In another embodiment, such as an embodiment in which said light is mounted below a work surface such as a counter or sink, said light is mounted at a height generally below 34 inches. In another embodiment, such as an embodiment in which the light is mounted below a control panel of said control system, said light is mounted at a height generally below 30 inches.

In another embodiment of the condition warning system said light is mounted in a location that is remote from said apparatus. For example, the light may be mounted at a location in which the apparatus (such as the pot and pan washing machine) is not visible by the operator. For example, the operator may be located at a drive through counter of a quick serve restaurant (away from the pot and pan washing machine), and the light may thus be mounted below the drive through counter. In another embodiment, the remote light is mounted at a position and focused in a direction that illuminates a location generally above an operator's direct line of site (such as a ceiling or upper portion of a wall). In such embodiment, the source of illumination may be located outside of the operator's direct line of sight (such as above a shelf or cabinet).

The foregoing and other objects are intended to be illustrative of the invention and are not meant in a limiting sense. Many possible embodiments of the invention may be made and will be readily evident upon a study of the following specification and accompanying drawings comprising a part thereof. Various features and subcombinations of invention may be employed without reference to other features and subcombinations. Other objects and advantages of this invention will become apparent from the following description taken in connection with the accompanying drawings, wherein is set forth by way of illustration and example, an embodiment of this invention and various features thereof.

BRIEF DESCRIPTION OF THE DRAWINGS

A preferred embodiment of the invention, illustrative of the best mode in which the applicant has contemplated applying the principles, is set forth in the following description and is shown in the drawings and is particularly and distinctly pointed out and set forth in the appended claims.

DETAILED DESCRIPTION OF A PREFERRED EMBODIMENT

As required, a detailed embodiment of the present invention is disclosed herein; however, it is to be understood that the disclosed embodiment is merely exemplary of the principles of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
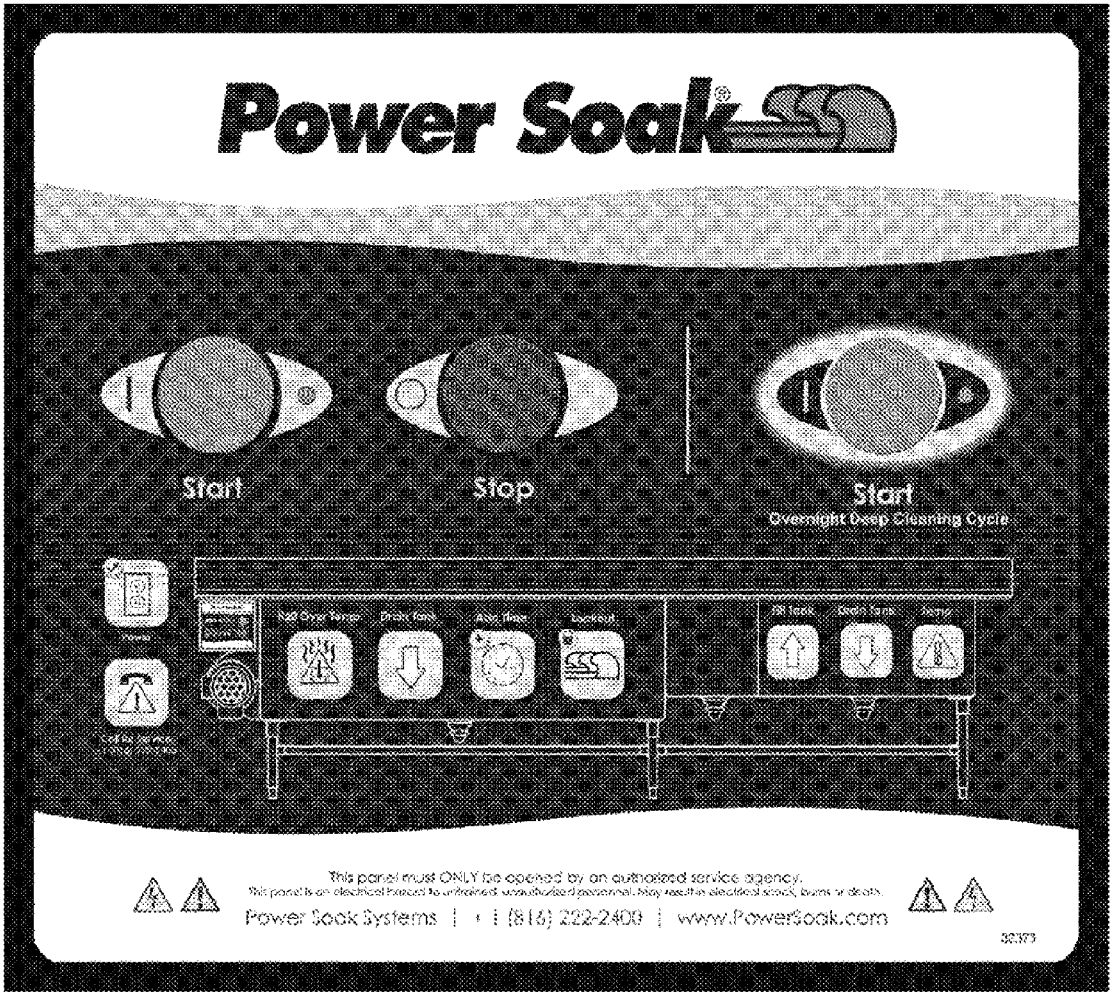
FIG. 1 is front view of the face of a control panel of a control system of an embodiment of the instant invention.
Figure 2:
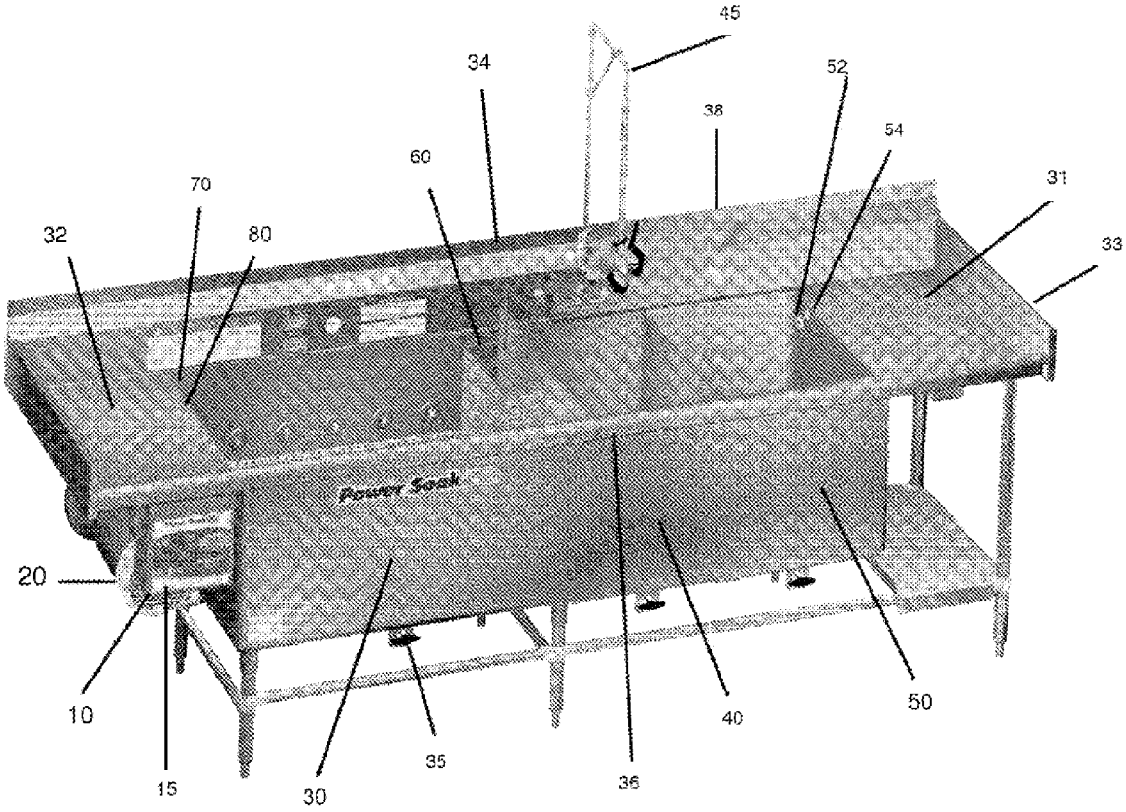
FIG. 2 is a perspective view of a continuous motion style pot and pan washing machine of the instant invention in which the control panel of FIG. 1 is utilized and including a condition warning system of an embodiment of the instant invention.

Referring to FIG. 1, the front face of a control panel of a control system of one embodiment of the instant invention is shown. Referring to FIG. 2, the control system of FIG. 1 is shown incorporated into a continuous motion style pot and pan washing machine. In a preferred embodiment, the control system includes a microprocessor, or other suitable computer processor, for performing various operations as defined in the firmware/software programming of the logic of the control system. The microprocessor includes, or is otherwise connected to one or more storage media, including but not limited to ROM, RAM, magnetic disk drives, etc., in which firmware for, software for and/or data collected or generated by the control system is utilized, accessed and/or stored. The microprocessor is connected to and/or controls all operational functions/components of the machine, including but not limited to: a wash pump, heater, chemical supply system pumps, valves (drain or fill), timers, temperature sensors, fluid level sensors, chemical/fluid supply level sensors, pressure sensors, chemical concentration sensors, washing cycle run time, etc.

Figure 3:
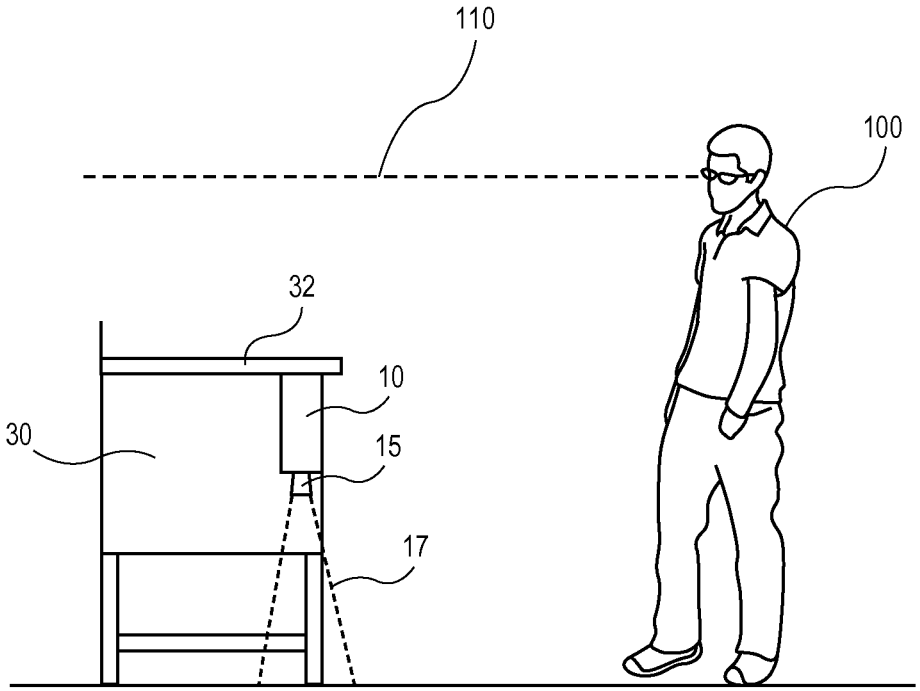
FIG. 3 is a side view of the pot and pan washing machine of FIG. 2 and an operator of the machine.
Figure 4:
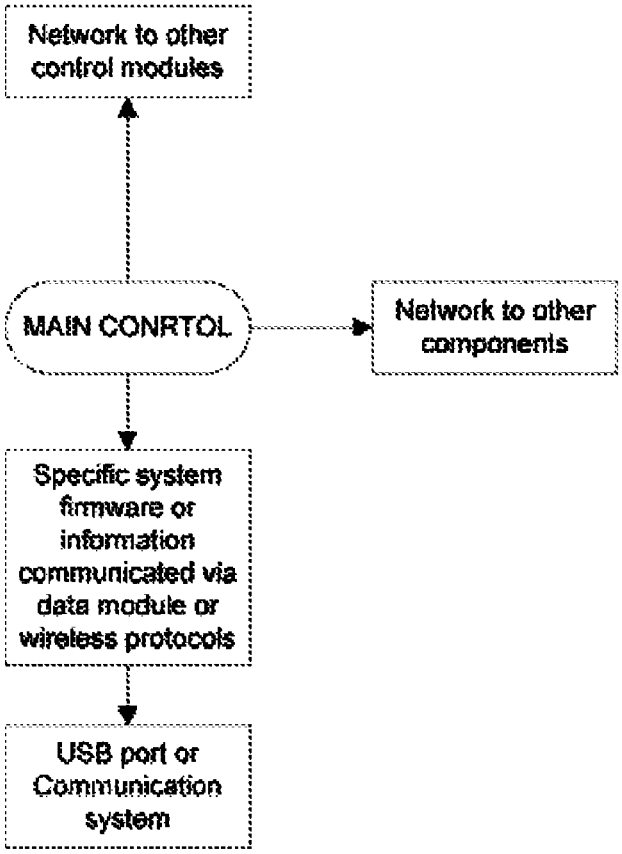
FIGS. 4 through 10 show flow diagrams of the operation and control logic of a control system of a preferred embodiment of the instant invention.

Referring to FIG. 2, the pot and pan washing machine includes wash tank 30, rinse tank 40, and sanitizer tank 50 connected together in a single unit via non-welded field joint 34. The unit also includes soiled end drain board 32, and clean end drain board 31 to direct fluids into wash tank 30 and sanitizer tank 50, respectively. The unit further includes backsplash 38 and channel rim 36. Wash tank 30 includes a plurality of jets along its rear wall which direct fluid from wash pump 20 (controlled by control system 10) into wash tank 30. An intake draws fluid back into wash pump 20 for continuous motion within wash tank 30. Wash tank also includes utensil basket 60 for washing utensils. In addition, wash tank 30 includes detergent injector 70 that is connected to a detergent supply system which is controlled by control system 10. Wash tank also includes fluid high and low sensors 80 connected to controller 10 to detect when the fluid level in the tank is drained below a minimum low level and raised above a minimum high level. In the embodiment shown in FIG. 2, rinse tank 40 includes a pre-rinse faucet for rinsing items in the rinse sink. In a preferred embodiment, rinse tank 40 also includes fluid level sensors that operate in the same or similar manner as those in the wash tank 30. Sanitizer tank 50 also includes similar fluid level sensors 52, as well as a sanitizer injector 54 that is connected to a sanitizer supply system controlled by control system 10. Control system 10 also controls condition warning light 15, which is mounted below control system 10, underneath the soiled end drain board, and which directs light onto the floor directly below the unit. As is shown in FIG. 3, condition warning light 15, directs light beam 17 into a controlled zone under the washing machine. Light beam 17 is directed to a location below operator 100's direct line of sight 110. Also light 15 is mounted at a location outside of operator 100's direct line of sight 110. In a preferred embodiment, light 15 is mounted at a height below 52 inches, which is well below the average operator's direct line of sight. In the embodiment shown in FIGS. 2 and 3, the light is mounted below control system 10, which results in a mounting height generally below 30 inches from the floor.

Referring to FIG. 1, the control panel includes several control buttons for input by an operator and a number of display indicators for monitoring by the operator. The control panel includes a power indicator that is illuminated when the control system is properly connected to electrical power. The panel includes a error (call service) indicator that illuminates when certain error conditions are detected by the control system. In certain conditions, the error light may illuminate in combination with other indicators to inform the operator of certain operational parameters that are not in compliance with one or more punitive lockout conditions.

The control panel includes an over temperature indicator that illuminates a solid color when the fluid temperature within the wash tank of the machine exceeds a first temperature that is outside the preferred operating temperature of the wash tank, but which is not at an unsafe level (i.e. 118 F). If the fluid temperature exceeds a second predetermined temperature that is closer to an unsafe operating temperature (i.e. 123 F), the temperature indicator flashes along with the error light, and operation of the wash pump is locked out until the temperature returns to a safe level, and the operator may select the start button input the restart operation. In addition, in a preferred embodiment, a condition warning light (described below) mounted under the control panel flashes when an over temperature condition is detected.

The control panel includes a drain wash tank indicator that lights up a solid color when the washing cycle has completed (i.e. the predetermined run-time has elapsed and met the run-time condition). The light goes out after the wash tank is drained below the low water sensor. In a preferred embodiment, in which an extended wash time is selected, the light also will go out for the period of the extended wash time.

The control panel includes an extend wash time indicator which functions during a standard washing cycle. At the end of the standard wash cycle, the indicator turns solid for a finite period of time (such as 15 minutes) to allow the operator to initiate by input of the start button the extended wash time for a finite period in which the wash pump will continue to operate and items/wares may continue to be washed without requiring draining and refilling of the wash tank with wash fluid (i.e. water, soap, etc.). This light remains illuminated during the entire extended wash cycle. After the finite extended wash cycle time (single time period, or combination of multiple periods) is completed, the wash tank must be drained and refilled to initiate a new washing cycle.

The control panel includes a wash motor lockout indicator which is illuminate whenever a wash action lockout occurs due to a compliance parameter meeting a punitive lockout condition (e.g. over temperature condition, fill sanitizer condition, sanitizer out of temperature range condition, etc.).

The control system includes a fill sanitizer tank indicator that illuminates red when in standard wash mode and the operator needs to fill the sanitizer tank (because the sanitizer is below the low level or high level sensors. If the fill is not performed in 10 minutes wash pump motor is locked out and lockout light is displayed. To indicate time, the light flashed from 3 minutes at an increasing rate to fully illuminated at 10 minutes.

The control system includes a drain sanitizer tank indicator that illuminates solid after a predetermined time period in which the control system measures that the sanitizer tank has been used without refilling the fluid.

The control system includes a start standard wash mode button to input a selection to the control system to start a normal washing cycle, and a start deep clean mode button to input a start of a deep clean washing cycle. Also the control system includes a stop button to stop the wash action and/or the wash pump.

The control system of FIGS. 1 and 2 includes a temperature sensor to monitor the temperature of fluid in the sanitizer tank and also includes an out of temperature rating indicator for the sanitizer tank. The system includes minimum and maximum temperature thresholds that may be set by a system operator or service professional for the system. For example, the minimum threshold is between 50 and 90 degrees F. (settable in 5 degree increments) and the maximum threshold is between 70 and 120 degrees F. (settable in 5 degree increments). This allows the system to maintain an optimum temperature range for sanitizer in the sanitizer tank. When the temperature goes out of the optimum range, the light is illuminated and the operator is required to drain and refill the sanitizer tank.

The system includes sensors toward the top and bottom of the sanitizer tank to sense whether fluid is in the tank and if the tank is being filled/drained or has been filed/drained. This allows the system to be fully (or partially) automated. The sanitizer tank is filled with water (or other appropriate fluid) to a level above the top sensor (the top sensor senses the water and causes a shut off of the filling source). If the temperature is outside of the set range, the water will be drained and refilled until the temperature is within the required range. Once the required temperature is reached, the sanitizer is added to the water in the sanitizer tank. The sanitizer may be added automatically using a pump. A dual head pump for pumping sanitizer into the sanitizer tank, and also for pumping detergent into the wash tank is utilized in one embodiment.

The system includes an extend standard wash time feature/indicator for the wash tank. The prior art system includes a 4 hour wash cycle, after which the wash tank must be drained and refilled before the system's circulating pump motor will function (unlock). The extend standard wash time feature allows a system operator to extend the wash time by 15 minutes. This allows the operator to finish minor cleaning jobs without requiring a timely refill.

The system further includes an energy efficient deep cleaning mode, that allows the system to operate in a cleaning cycle for a relatively long period of time (such as over night) to deep clean heavily soiled items in the wash tank utilizing as little energy as possible. The deep clean cycle of the instant invention includes a first cycle period in which the circulatory pump operates continuously (as it would in normal cleaning mode, such as the cleaning mode of the prior art) and maintains a temperature of 128 degrees F. After 2 hours, the pump (and heater) operates in 10 minute cycles, on for 10 minutes and off for 10 minutes, until the temperature falls below 115 F. Once this threshold is reached, the system (pump and heater) runs for 5 minutes and is then off for 15 minutes. The control system will operate the pump and/or heater more often if the temperature falls below 113 F, so as to maintain a temperature between 113 and 115 F. The system operates in this manner (holding the 113-115 F temperature) until it is turned off by the operator. This allows the system to deep clean items for a long period of time (in excess of the typical 4 hour cleaning cycle), such as overnight.

Because items needing deep cleaning (as in the deep clean cycle described above) often require a stronger cleaning detergent than is typically used for normal cleaning of pots and pans, the system of the instant invention utilizes a 3 head pump instead of the two head (parasitic) pump described above to inject both a liquid detergent and a solid detergent into the wash tank, and the sanitizer into the sanitizer tank.

One preferred embodiment of the instant invention includes a condition warning system that is designed to notify system users of a condition requiring user action in a distinct and easily recognizable manner. In one embodiment a bright warning light is activated to signal the condition to the user. In a preferred embodiment, the warning light is a flashing blue light such as those used in unmarked police cruisers. The light is positioned below the control panel of the washing machine in the manner shown in FIGS. 2 and 3. The location of the light, below the control panel of and/or underneath the machine, at a location that is typically darker than the environment in which the machine is located due to the shading/shadows caused by the machine itself, optimizes the user's ability to recognize the light when it is activated. The control system of the instant invention activates the light when a condition requiring user attention is detected by the control system, illuminating the typically darkened/shaded underside of the machine in the manner shown in FIG. 3. For example, the system of the instant invention may include a drain wash tank indicator on the face of the control panel. In the embodiment shown herein, this indicator will start flashing 30 minutes before the wash cycle is scheduled to end and will turn solid at the end of the 4 hour wash cycle to indicate that the wash tank must be drained. As this drain wash tank indicator is typically only visible to a user located in the proximity of the system, and may not be noticed for some time by a user located away from the system (such as on the other side of a kitchen in which the system is located) the warning light of the instant invention will also be activated by the control system of the invention to bring the condition to the user's attention regardless of whether the user is in the proximity of the system or across the room, etc. It will be appreciated that the warning light of the instant invention may be utilized to signal a variety of differing conditions. For example purposes only, the warning light of the instant invention may be utilized to signal such other conditions as errors, over temperature wash water, fill/drain sanitizer tank, out of temperature rating for sanitizer, etc. In one preferred embodiment, the color of the light, the number of flashes, pattern of flashes and/or frequency of flashes is varied to signal differing conditions. For example, a solid, non-flashing red light might indicate an end of wash cycle condition, while a flashing read light could indicate an error condition and a flashing orange light might indicate an over temperature condition, etc.

Figure 5:
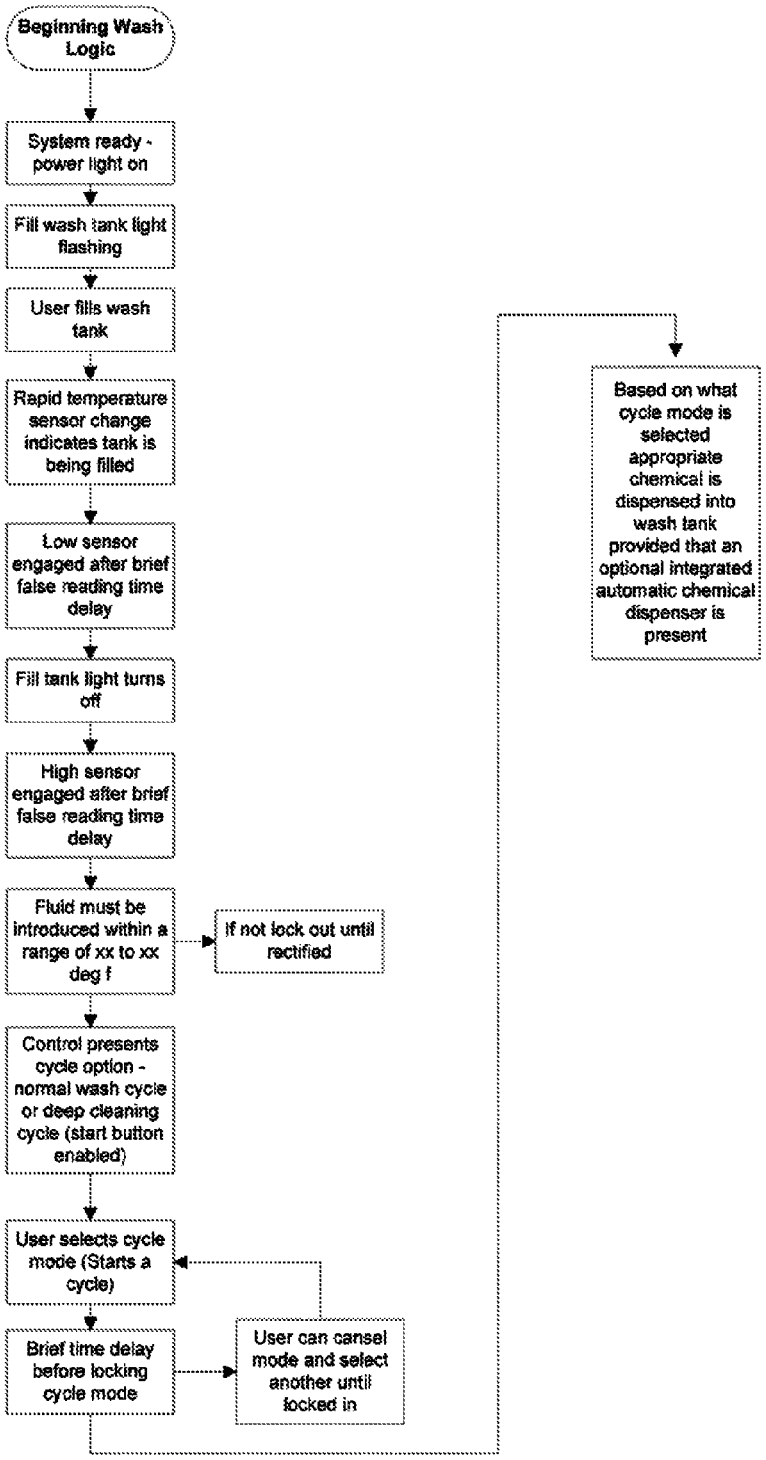
Figure 6:
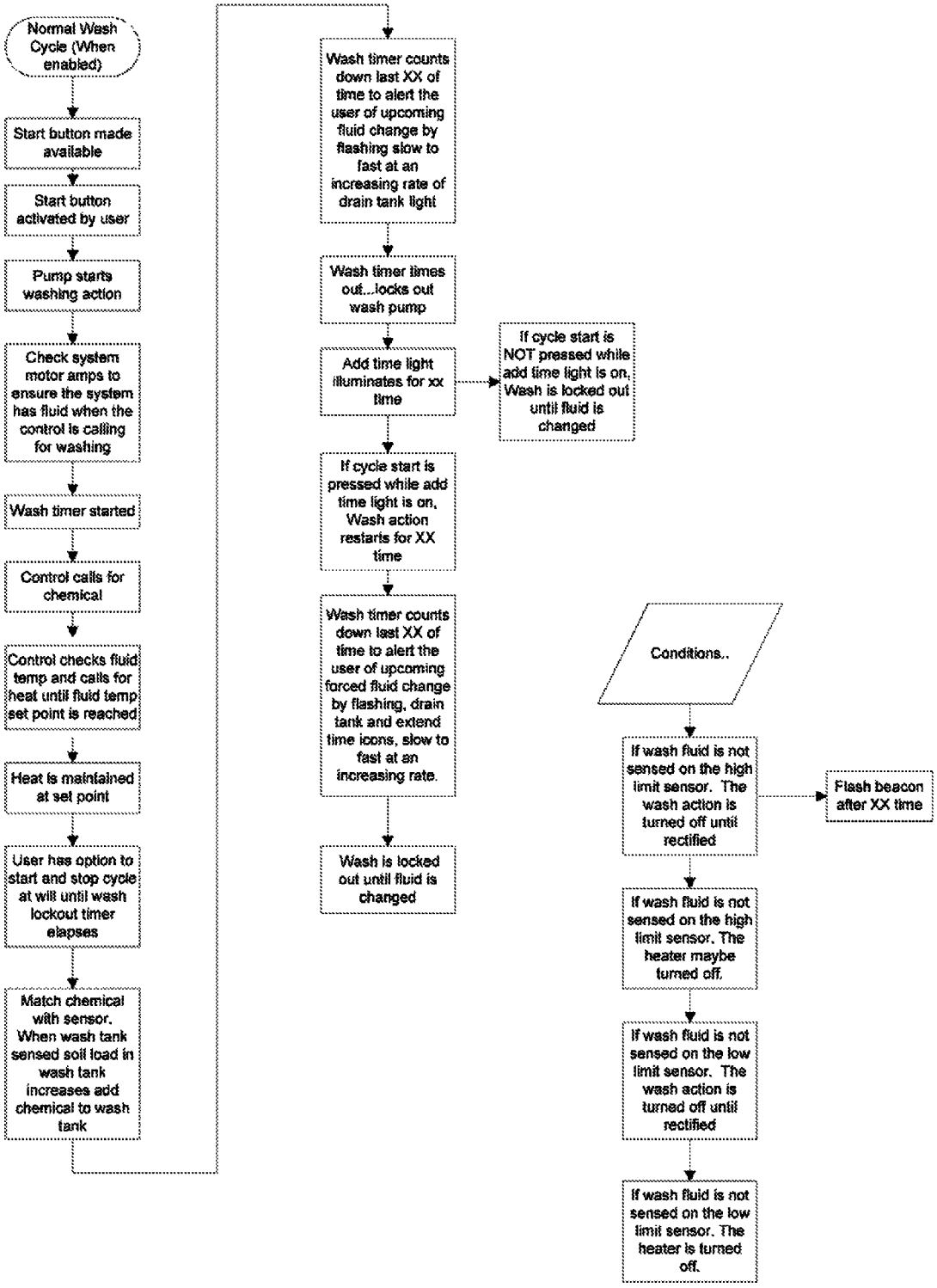
Figure 7:
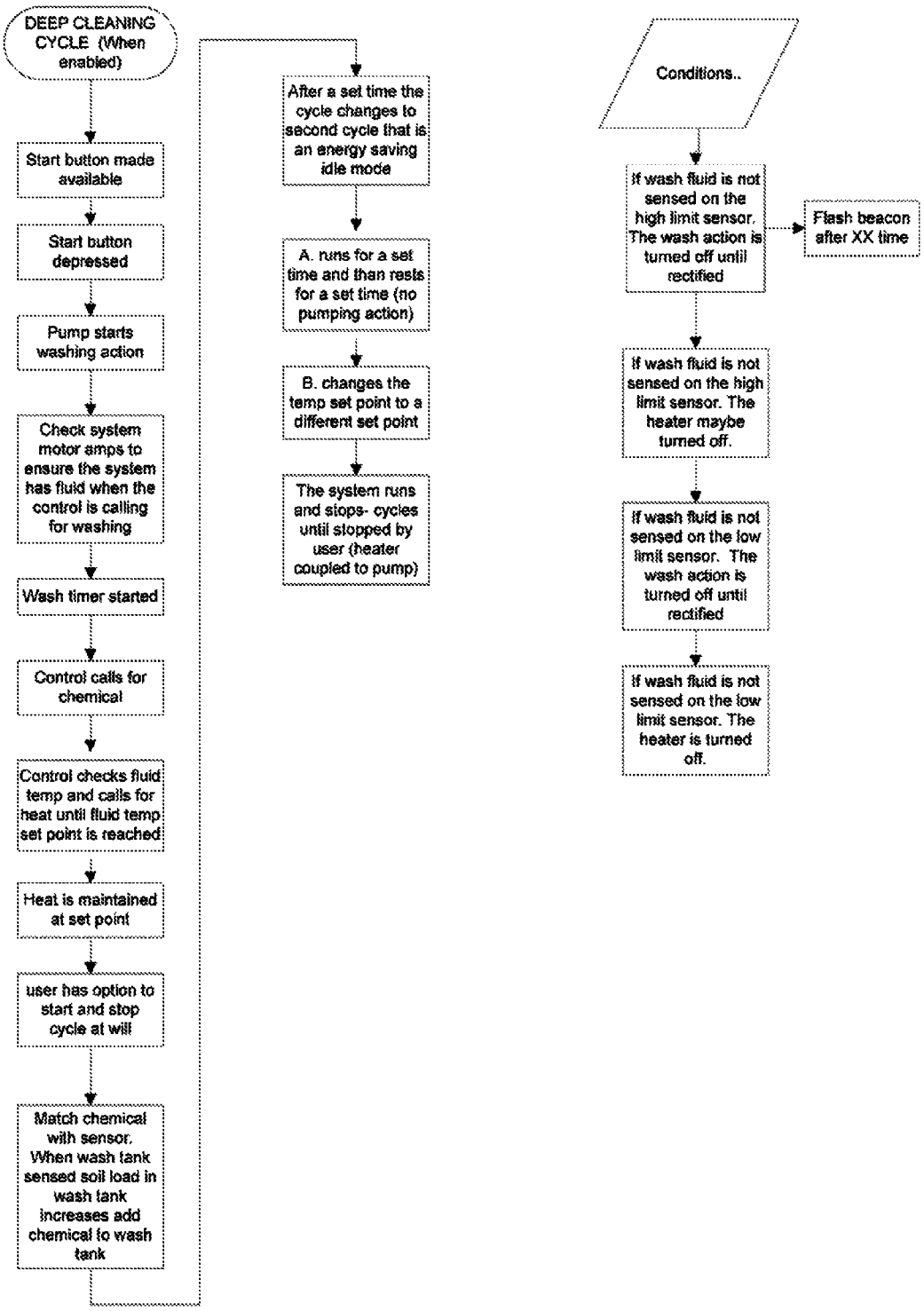
Figure 8:
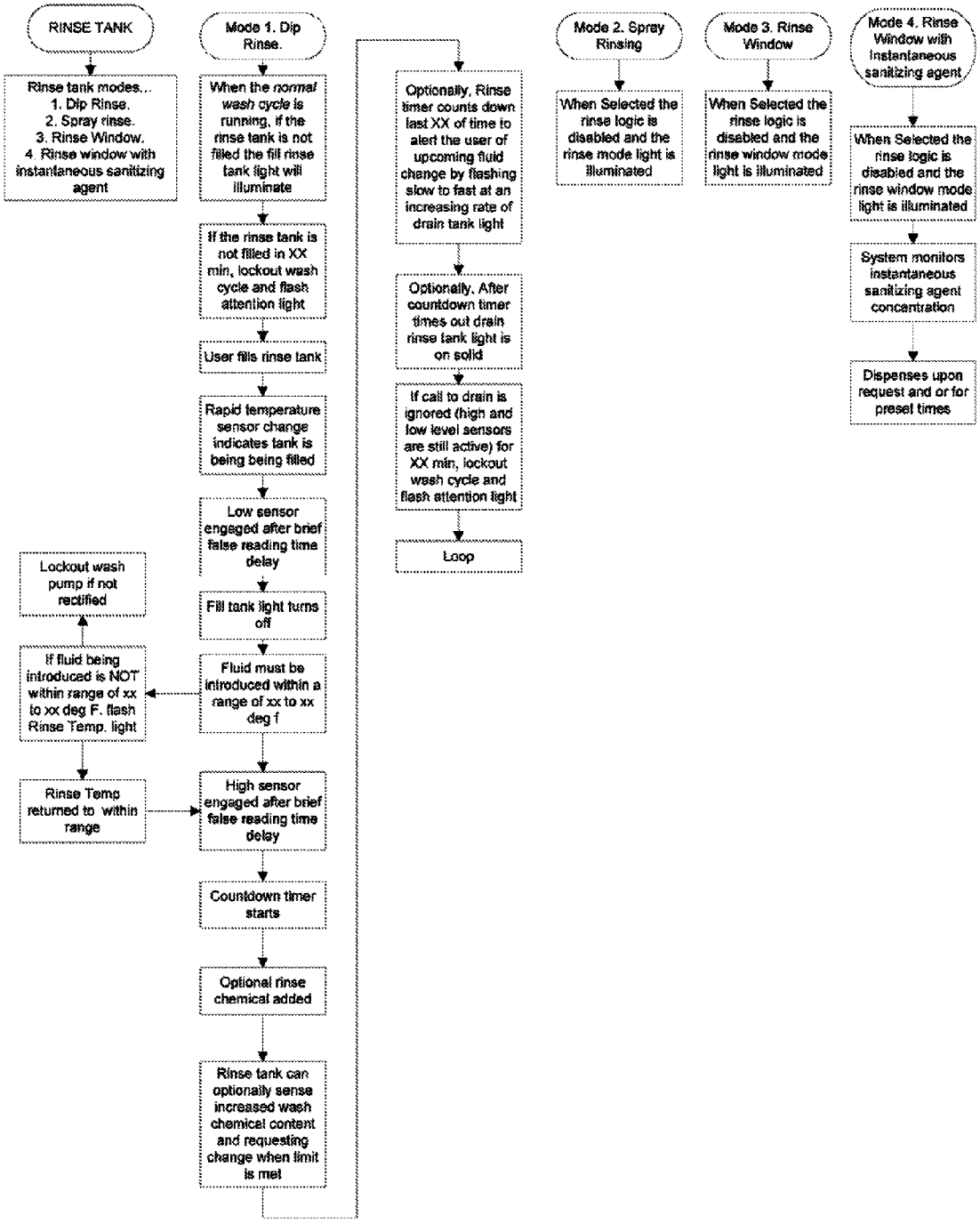
Figure 9:
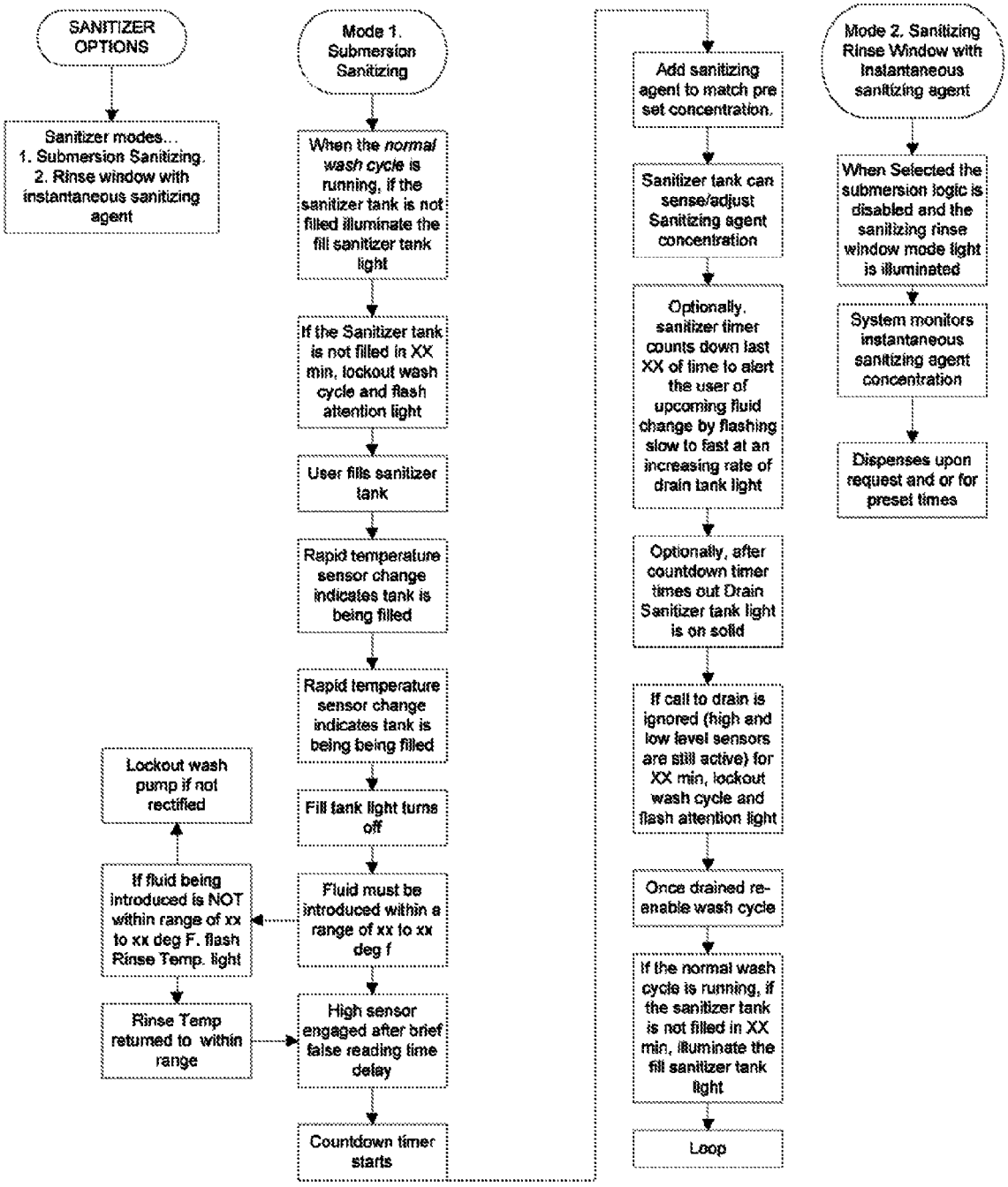
Figure 10:
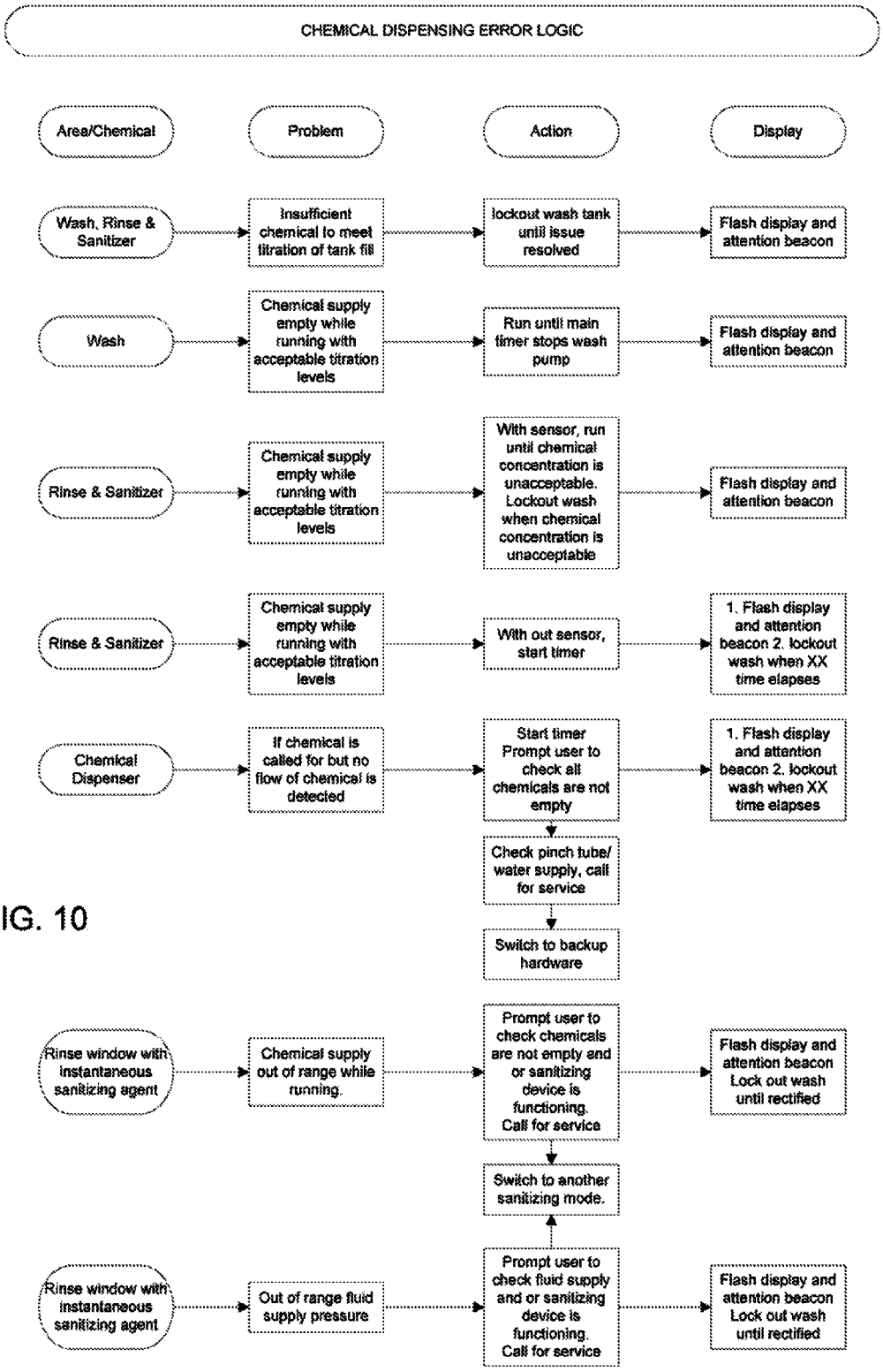

FIGS. 4 through 10 show flow diagrams of the operation and control logic of a control system of a preferred embodiment of the instant invention. As is shown in FIG. 5, the main control module of the control system of a washing machine may be networked to other control modules or other components, and includes specific firmware or information that may be communicated or installed via data modules such as USB port located on the control system panel or wirelessly. FIG. 6 shows the beginning wash logic in which a wash tank is filled to a monitored level and temperature. FIG. 7 shows a normal wash (standard) cycle that may be selected by an operator once the wash tank is filled to the proper fluid level and/or temperature, etc. as shown in FIG. 6. FIG. 7 also shows conditions in which lockout and/or condition warning system will be utilized. FIG. 8 shows a deep cleaning wash cycle that may be selected by the operator once the wash tank is filled, instead of the standard cycle. FIG. 8 also shows conditions in which lockout and/or condition warning are activated by the control system. FIG. 9 shows various rinse modes that may be utilized in connection with the system of the instant invention, including a dip rinse, spray rinse, and several rinse window systems (as further described in U.S. Application Ser. No. 61/178,617 filed on May 15, 2009 and incorporated herein by reference in its entirety. FIG. 10 shows various sanitize modes that may be utilized in connection with the system of the instant invention.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the inventions is by way of example, and the scope of the inventions is not limited to the exact details shown or described.

Although the foregoing detailed description of the present invention has been described by reference to an exemplary embodiment, and the best mode contemplated for carrying out the present invention has been shown and described, it will be understood that certain changes, modification or variations may be made in embodying the above invention, and in the construction thereof, other than those specifically set forth herein, may be achieved by those skilled in the art without departing from the spirit and scope of the invention, and that such changes, modification or variations are to be considered as being within the overall scope of the present invention. Therefore, it is contemplated to cover the present invention and any and all changes, modifications, variations, or equivalents that fall with in the true spirit and scope of the underlying principles disclosed and claimed herein. Consequently, the scope of the present invention is intended to be limited only by the attached claims, all matter contained in the above description and shown in the accompanying drawings shall be interpreted as illustrative and not in a limiting sense.

Having now described the features, discoveries and principles of the invention, the manner in which the invention is constructed and used, the characteristics of the construction, and advantageous, new and useful results obtained; the new and useful structures, devices, elements, arrangements, parts and combinations, are set forth in the appended claims.

It is also to be understood that the following claims are intended to cover all of the generic and specific features of the invention herein described, and all statements of the scope of the invention which, as a matter of language, might be said to fall therebetween.

What is claimed is:

1. A method of washing wares in a continuous motion style pot and pan washing machine, said method comprising the steps of:

causing, via a wash pump, a recirculating fluid flow path of a volume of fluid within a tank of said washing machine;

monitoring by a control system one or more compliance parameters relating to operation of the pot and pan washing machine during normal operation;

locking out punitively and temporarily by said control system operation of the wash pump based upon said one or more compliance parameters meeting one or more specified punitive lockout conditions, wherein said locking out step includes the step of locking out the operation of the wash pump during a washing cycle when said one or more compliance parameters meet said one or more punitive lockout conditions;

maintaining said volume of fluid within said tank after said control system performs said locking out step; and restoring operation of the wash pump when said one or more compliance parameters no longer meet said one or more punitive lockout conditions, wherein said restoring step includes allowing said wash pump to recirculate said volume of fluid within said tank.

2. The method as claimed in claim 1 wherein said restoring step is performed without requiring the complete draining or refilling of one or more tanks of the pot and pan washing machine.

3. The method as claimed in claim 1 wherein said restoring step requires substantially completely draining and refilling of one or more tanks of the pot and pan washing machine without resetting said washing cycle.

4. The method as claimed in claim 1 wherein said step of locking out the operation of the wash pump interrupts a timed length of said washing cycle.

5. The method as claimed in claim 1 wherein said step of locking out the operation of the wash pump does not interrupt a timed length of said washing cycle.

6. The method as claimed in claim 1 wherein said continuous style pot and pan washing machine includes more than one wash pump.

7. The method as claimed in claim 1 wherein said one or more compliance parameters includes one or more of fluid temperature, fluid level, or fluid chemical concentration level within a wash tank of the pot and pan washing machine, and wherein said one or more punitive lockout conditions includes one or more of a fluid temperature above a predetermined high limit or below a predetermined low limit, a fluid level above a predetermined limit or below a predetermined limit, or a fluid chemical level above a predetermined limit or below a predetermined limit.

8. The method as claimed in claim 7 wherein said one or more compliance parameters includes fluid temperature and said one or more punitive lockout conditions includes a fluid temperature above a predetermined high limit, said method further comprising the step of requiring substantially completely draining and refilling the wash tank to resume normal operation if said fluid temperature exceeds a second predetermined safety limit that is in excess of said high limit.

9. The method as claimed in claim 1 wherein said one or more compliance parameters includes one or more of fluid temperature, fluid level or fluid chemical concentration level within a sanitizer tank of the pot and pan washing machine, and wherein said one or more punitive lockout conditions includes one or more of a fluid temperature above a predetermined limit or below a predetermined limit, a fluid level above a predetermined limit or below a predetermined limit, or a fluid chemical concentration level above a predetermined limit or below a predetermined limit.

10. The method as claimed in claim 9 wherein the pot and pan washing machine includes a wash tank in addition to the sanitizer tank and wherein said locking out step includes the step of locking out punitively temporarily the operation of a wash pump for the wash tank.

11. The method as claimed in claim 1 wherein said one or more compliance parameters includes one or more of fluid temperature, fluid level or fluid chemical concentration level within a rinsing tank of the pot and pan washing machine, and wherein said one or more punitive lockout conditions includes one or more of a fluid temperature above a predetermined limit or below a predetermined limit, a fluid level above a predetermined limit or below a predetermined limit, or a fluid chemical concentration level above a predetermined limit or below a predetermined limit.

12. The method as claimed in claim 11 wherein the pot and pan washing machine includes a wash tank in addition to the rinsing tank and wherein said locking out step includes the step of punitively temporarily locking out the operation of a wash pump for the wash tank.

13. The method as claimed in claim 1 wherein said one or more compliance parameters includes one or more of fluid temperature, fluid level or fluid chemical concentration level within a spray rinsing system of the pot and pan washing machine, and wherein said one or more punitive lockout conditions includes one or more of a fluid temperature above a predetermined limit or below a predetermined limit, a fluid level above a predetermined limit or below a predetermined limit, a fluid chemical concentration level above a predetermined limit or below a predetermined limit, or a fluid pressure above a predetermined limit or below a predetermined limit.

14. The method as claimed in claim 13 wherein the pot and pan washing machine includes a wash tank in addition to the spray rinsing system and wherein said locking out step includes the step of punitively temporarily locking out the operation of a wash pump for the wash tank.

15. The method as claimed in claim 1 wherein said one or more compliance parameters includes one or more chemical supply levels, pressures or concentrations within a chemical supply system that supplies chemical to one or more tanks or spray rinsing systems of the pot and pan washing machine, and wherein said one or more punitive lockout conditions includes at least one chemical supply level below a predetermined level, pressure or concentration.

16. The method as claimed in claim 1 further comprising the step of activating a condition warning system during said locking out step.

17. The method as claimed in claim 16 wherein said condition warning system includes a light that is focused to illuminate a location on a ground surface that is supporting the washing machine.

18. The method as claimed in claim 16 wherein said condition warning system includes an audible alarm.

* * * * *